US005399209A

United States Patent [19]

Suda et al.

[11] Patent Number: 5,399,209

[45] Date of Patent: Mar. 21, 1995

[54] COMPOSITION AND METHOD FOR CHROMATING TREATMENT OF METAL

[75] Inventors: Arata Suda; Takao Ogina, both of Hiratsuka, Japan

[73] Assignee: Henkel Corporation, Plymouth Meeting, Pa.

[21] Appl. No.: 980,810

[22] PCT Filed: Aug. 23, 1991

[86] PCT No.: PCT/US91/06017

§ 371 Date: Mar. 1, 1993

§ 102(e) Date: Mar. 1, 1993

[87] PCT Pub. No.: WO92/03594

PCT Pub. Date: Mar. 5, 1992

[30] Foreign Application Priority Data

Aug. 28, 1990 [JP] Japan ..... 2-224396

[51] Int. Cl.[6] ..... C23C 22/33

[52] U.S. Cl. ..... 148/258

[58] Field of Search ..... 148/258

[56] References Cited

U.S. PATENT DOCUMENTS 4,971,636 11/1990 Watanabe ..... 148/258

FOREIGN PATENT DOCUMENTS 0274543 7/1988 European Pat. Off. .
0348890 1/1990 European Pat. Off. .
0372915 6/1990 European Pat. Off. .
1075264 10/1954 France .
2543519 4/1976 Germany ..... 148/258
45-02090 1/1970 Japan ..... 148/258
56-036868 8/1981 Japan .
57-67195 4/1982 Japan .
57-174469 10/1982 Japan .
59-171645 9/1984 Japan .
60-018751 5/1985 Japan .
60-105535 6/1985 Japan .
60-037880 8/1985 Japan .
61-073900 4/1986 Japan .
0178873 7/1988 Japan ..... 148/258

*Primary Examiner*—Sam Silverberg
*Attorney, Agent, or Firm*—Ernest G. Szoke; Wayne C. Jaeschke; Norvell E. Wisdom, Jr.

[57] ABSTRACT

A chromate conversion coating with excellent cold workability and protection against corrosion after subsequent painting can be formed on metal surfaces, particularly on galvanized steel sheet, by drying in place on the metal an amount of an acidic aqueous composition comprising (A) from 4.0 to 51.0 g/L of hexavalent chromium; (B) from 6.0 to 38.0 g/L of trivalent chromium; (C) from 0.5 to 97.0 g/L of phosphate ions; (D) a component selected from the group consisting of sulfate ions, nitrate ions, fluoride ions, and mixtures thereof; and (E) a component selected from the group consisting of cations of Cu, Co, Ni, Sn, Fe, and Pb and mixtures thereof, wherein the trivalent chromium/hexavalent chromium weight ratio is in the range from 0.2 to 1.4. Preferably the amount of aqueous composition used is such as to produce a chromium add-on of from 20–160 $mg/m^2$.

7 Claims, No Drawings

COMPOSITION AND METHOD FOR CHROMATING TREATMENT OF METAL

TECHNICAL FIELD

The present invention relates to a chromate treatment composition and method which impart a high workability and excellent electrodeposition paintability to metal surfaces. More particularly, the present invention relates to a chromating composition and treatment method which provide an excellent workability and excellent electrodeposition paintability after contact with the surface of zinciferous surfaced iron or steel sheet. (Throughout this description, except where the immediate context requires otherwise, the terms "zinc" and "galvanized" are to be understood as including not only pure zinc but those of its alloys that are predominantly zinc in composition.)

BACKGROUND ART

Although galvanized steel sheet and zinc alloy-plated steel sheet generally have an excellent corrosion resistance, they are nevertheless subject to a number of problems. One such problem is the nonuniform deposition of the plating metal on the surface of the zinc-plated steel sheet, particularly on galvannealed hot-dip-galvanized steel sheet. This nonuniform deposition promotes cratering during subsequent electrodeposition painting, as a result of an inhomogeneous surface electrical conductivity and/or a nonuniform surface morphology on the steel sheet. In addition, galvanized steel sheet suffers from problems with its workability due to the occurrence of powdering during such working operations as press forming, etc.

The prior art offers the following countermeasures to these problems associated with zinc (alloy) plating.

The method disclosed in Japanese Patent Application Laid Open [Kokai or Unexamined] Number 57-67195 [67,195/82] exploits the superior phosphate conversion treatability and paint film adherence of iron-plated surfaces relative to zinc-plated surfaces. This is achieved in this case by iron-plating (to a prescribed thickness) at least one surface of duplex zinc-plated steel sheet.

Japanese Patent Publication Number 60-37880 [37,880/85] proposes a method for obtaining surface-treated steel sheet which has an excellent secondary adherence for cationic electrodeposition paint films. This is achieved by first iron plating the surface of zinc-plated, zinc composite-plated, or zinc alloy-plated steel sheet and by then executing a thin chromate treatment thereon.

Japanese Patent Application Laid Open Number 59-171645 [171,645/84] teaches a reduction of powdering through the formation of a zinc-rich film (with prescribed proportions of zinc powder and zinc/magnesium alloy powder) over a chromate film on particular types of galvanized steel sheet.

In the method disclosed in Japanese Patent Application Laid Open Number 60-105535 [105,535/85], a chromate film in a prescribed weight and a zinc-rich film layer in a prescribed thickness are overlaid onto Zn/Ni alloy-plated steel sheet. It is reported that powdering is reduced due to the zinc-rich layer.

Japanese Patent Publication Number 56-36868 [36,868/81] discloses a method in which a specified add-on of a nickel plating layer and then a specified add-on of chromate film are formed on zinc-plated steel sheet.

Japanese Patent Publication Number 60-18751 [18,751/85] teaches an improvement in the paint film adherence afforded by a chromate treatment which itself is the subject of a previous patent application. This is achieved by coating the surface of zinc-plated steel sheet with an aqueous solution which contains chromic anhydride, silicic acid colloid, and pyrophosphoric acid. The application of this bath is followed by drying without a water rinse.

The method disclosed in Japanese Patent Application Laid Open Number 61-73900 [73,900/86] proposes the inhibition of cratering in cationic electrodeposition by the formation of a pure zinc-plate film in a prescribed weight on the plated surface of zinc alloy-plated steel sheet.

DESCRIPTION OF THE INVENTION

Problems to be Solved by the Invention

In all the methods of the above-described prior art, it is difficult simultaneously to obtain excellent performance levels for both the electrodeposition paintability and press workability. These methods are also encumbered by other problems such as a complicated treatment regime and tedious process management.

Summary of the Invention

It was discovered that the problems which encumber the prior art can be avoided by use of an aqueous chromate treatment bath that contains one or more selections from the sulfate ion, nitrate ion, and fluoride ion plus one or more selections from Co, Ni, Sn, Cu, Fe, and Pb cations in an aqueous solution containing 4.0 to 51.0 grams per liter (hereinafter "g/L") of hexavalent chromium, 6.0 to 38.0 g/L of trivalent chromium, and 0.5 to 97.0 g/L of phosphate ions, wherein the trivalent chromium/hexavalent chromium weight ratio is 0.2 to 1.4. In a process embodiment of the invention, the composition as noted above is applied to a metal surface, especially a surface of zinc-plated steel sheet, followed by drying to form a chromate film with a chromium add-on of 20 to 160 mg/m$^2$ on the surface thereof.

Details of Preferred Embodiments of the Invention

The composition of the aqueous chromate bath according to the present invention will be considered first.

This chromate bath employs water as its solvent and contains 4.0 to 51.0 g/L hexavalent chromium and 6.0 to 38.0 g/L trivalent chromium as its fundamental components.

The formation of a satisfactorily corrosion resistant chromate film is compromised at hexavalent chromium concentrations below 4.0 g/L and at trivalent chromium concentrations below 6.0 g/L. On the other hand, a hexavalent chromium concentration in excess of 51.0 g/L or a trivalent chromium concentration in excess of 38.0 g/L causes an increase in the chromate bath's viscosity as well as a reduced chromate bath stability which hinders control of the chromium add-on.

Another crucial aspect with regard to the chromium content is the proportion between trivalent and hexavalent chromium, and the trivalent chromium/hexavalent chromium weight ratio must fall within the range of 0.2 to 1.4. This chromium weight ratio can be regulated by the addition, as required, of a known reductant, for example, ethanol, methanol, oxalic acid, starch, sucrose, and the like.

The quality of the chromate bath is degraded when the chromium weight ratio falls below 0.2, because hexavalent chromium reduction reaction tends to develop in the chromate bath rather easily due to the activity of the non phosphate acid ion. In contrast to this, the chromate bath tends to gel and the corrosion resistance of the chromate film obtained is diminished when this chromium weight ratio exceeds 1.4.

Another component of the chromate bath of the present invention is the phosphate ion at 0.5 to 97.0 g/L. The phosphate ion is preferably added as orthophosphoric acid ($H_3PO_4$) and this acid and all anions derived from its ionization are considered as their stoichiometric equivalent of phosphate ion in determining the concentration of phosphate ions as defined herein. The chromate film evidences a diminished corrosion resistance and alkali resistance at less than 0.5 g/L phosphate ion. Formation of a protective surface layer by the chromate bath becomes unsatisfactory at more than 97.0 g/L of phosphate ions.

The non-phosphate acid anions added to the chromate treatment bath (one or more selections from sulfate ions, nitrate ions, and fluoride ions) function to etch the surface of the treatment workpiece when the chromate bath is applied. This supports partial substitution of the Zn on the surface by the additional metal cations present in the chromate treatment bath. In addition, when the chromate bath treated workpiece is subsequently dried without a water rinse, a chromate film (conversion coating layer) is formed.

The addition of an acid salt, such as copper nitrate, copper sulfate, nickel sulfate, and the like, obviates the need for a separate addition of the aforesaid acid ion and metal ion.

When the concentration in the chromate treatment bath of the acid ion(s) selected from sulfate ion, nitrate ion, and fluoride ion falls below 0.01 mole/L, the degree of etching of the surface of the treatment workpiece by said acid ions will usually be unsatisfactory and formation of an adequately protective surface layer may be impaired. On the other hand, when this concentration exceeds 2.9 mole/L, the surface of the treatment workpiece may be overly etched by the acid ions, and the corrosion resistance afforded by the material undergoing treatment, e.g., the zinc or zinc rich plating of the zinc-plated steel sheet, could be diminished. As a consequence of these considerations, the preferred range for the acid ion concentration is 0.01 to 2.9 mole/L.

When the concentration in the chromate treatment bath of the metal ions selected from Co, Ni, Sn, Cu, Fe, and Pb falls below 0.003 mole/L, the thickness of the protective film may be lower than desirable. When this concentration exceeds 0.85 mole/L, the thickness of the coated film may become excessive and adhesion between the chromate film layer and the treatment workpiece might decline. Also, if the concentration of acid ion in the chromate treatment bath is less than is desirable and the metal ion in the chromate treatment bath exceeds 0.85 mole/L, metal ions may be incorporated into the surface film in a form which will change into the metal oxide or hydroxide with time. The result would be a diminution in the corrosion resistance afforded by the surface film.

The chromate bath according to the present invention is preferably applied to the surface of zinc-plated steel sheet by some method that controls the amount applied so as to be uniform over the entire surface treated with at least moderate precision, for example, by a roll coater, and the substantially uniform layer of aqueous composition on the metal is then dried, without any intermediate rinsing. While the drying conditions are not specifically restricted in the present invention, the steel sheet receiving the treatment is preferably dried at a sheet temperature of 60° to 260° C. for 3 to 60 seconds. The chromium uptake or add-on should preferably fall within the range of 20 to 160 milligrams per square meter (hereinafter "$mg/m^2$"). When the chromium add-on falls below 20 $mg/m^2$, the chromate film will usually have an inadequate corrosion resistance and post-painting corrosion resistance. Values in excess of 160 $mg/m^2$ are associated with the following problems: It becomes difficult to control the chromium add-on; a further improvement in the corrosion resistance cannot be expected; and the chromate film then can sometimes be easily locally delaminated by external force, thereby impairing the paint film adherence and weldability.

The nonuniform surface morphology on the treated workpiece and the inhomogeneous surface electrical conductivity are eliminated by the chromate film formed on the workpiece by a method of the present invention. This results in a suppression of cratering during electrodeposition painting. In addition, lubricity is imparted to the surface, so that a forming tool readily slides along the workpiece during press forming operations, and the powdering phenomenon which accompanies delamination of the zinc plating layer is eliminated. The combination of these two effects leads to an improvement in the working efficiency.

The practice of the invention may be further appreciated from the following non-limiting working examples and comparison examples.

EXAMPLES

General Conditions Applicable to the Examples

Chromating agents with the compositions reported in Table 1 for Examples 1 to 6 and Comparison Examples 1 to 6

TABLE 1

| chromating bath | $Cr^{3+}$ g/L | $Cr^{6+}$ g/L | $Cr^{3+}/Cr^{6+}$ | $PO_4^{3-}$ g/L |
|---|---|---|---|---|
| examples according to the present invention | | | | |
| 1 | 25.0 | 25.0 | 1.0 | 50.0 |
| 2 | 6.0 | 30.0 | 0.2 | 20.0 |
| 3 | 5.6 | 4.0 | 1.4 | 32.0 |
| 4 | 38.0 | 51.0 | 0.75 | 25.0 |
| 5 | 10.0 | 48.0 | 0.21 | 0.5 |
| 6 | 35.0 | 25.0 | 1.4 | 97.0 |
| comparison examples | | | | |
| 1 | 25.0 | 25.0 | 1.0 | 50.0 |
| 2 | 6.0 | 30.0 | 0.2 | 20.0 |
| 3 | 5.6 | 4.0 | 1.4 | 32.0 |
| 4 | 38.0 | 51.0 | 0.75 | 25.0 |
| 5 | 10.0 | 48.0 | 0.21 | 0.5 |
| 6 | 35.0 | 25.0 | 1.4 | 97.0 |

Chromic anhydride was used to give the $Cr^{6+}$. For the $Cr^{3+}$, chromic anhydride was reduced with methanol in 300 mL water, and this was then made into an aqueous solution with the suitable concentration.

| chromating bath | acid ion mole/L | metal ion mole/L |
|---|---|---|
| examples according to the present invention | | |
| 1 | nitrate ion 0.5<br>fluoride ion 1.25 | Cu 0.45 |
| 2 | sulfate ion 1.00 | Sn 0.23 |
| 3 | fluoride ion 0.01 | Pb 0.003 |
| 4 | fluoride ion 1.00 | Ni 0.70 |

TABLE 1-continued

| | | |
|---|---|---|
| | nitrate ion 0.2 | |
| 5 | nitrate ion 0.20 | Co 0.30 |
| 6 | sulfate ion 2.90 | Fe 0.85 |
| comparison examples | | |
| 1 | | |
| 2 | | |
| 3 | | |
| 4 | | |
| 5 | | |
| 6 | | |

were respectively prepared and were diluted with water as appropriate. Each of these was roll coated on trichloroethylene degreased Zn/Ni-plated steel sheet and galvannealed hot-dip-galvanized steel sheet, followed in each case by drying at 180° C. without a water rinse.

The chromium add-on in each chromate film layer was measured by X-ray fluorescence and was found to be approximately 70 mg/m$^2$ in all cases. The presence of other metals than chromium and zinc in the surface films produced by the compositions of the working examples according to the invention, which contain cations of such metals, was also confirmed by this same X-ray fluorescence.

The specimens prepared as described above were subjected to performance evaluation on the following points.

(1) Primary Adhesion Testing

1. Checkerboard adhesion test: Using a cutter, one hundred squares 1 millimeter (hereinafter "mm") on each side were scribed so as to reach the substrate. Cellophane tape was overlaid on this and then peeled off, and the proportion of residual paint film was scored.
2. Dupont impact test: A weight (diameter=12.7 mm, mass=500 g) was dropped onto the painted surface from a height of 50 cm, and the painted surface was then visually scored according to the following scale:
   +++: no detectable paint film peeling
   ++: paint film peeling, but less than 10%
   +: paint film peeling ≧10%, <30%
   x: paint film peeling at least 30%
3. Erichsen extrusion test: The painted surface was extruded 6 mm using an Erichsen extruder, and the painted surface was then visually scored for cracking and peeling, according to the same scale as shown above for the Dupont impact test.

(2) Salt Spray Testing

According to the stipulations of Japanese Industrial Standard ("JIS") Z 2371, a cross was scribed using a cutter from the paint film to reach the substrate, and testing was conducted for 1,000 hours. The corrosion resistance was evaluated based on the amount of rust generated over the entire surface of the test coupon, and reported according to the following scale:

+++: area of rust formation 0%
++: area of rust formation >0 but <10%
+: area of rust formation ≧10% but <30%
x: area of rust formation at least 30%

(3) Secondary Adhesion Testing

Checkerboard adhesion testing was performed as for primary adhesion testing, but after the paint surface had been subjected to 1,000 hours of salt spray testing. Scoring and reporting were the same as for primary adhesion testing.

(4) Electrodeposition Paintability

A chromated sample prepared as described above was coated with an electrodeposition paint (EL-9400 from Kansai Paint) at an electrodeposition voltage of 350 V and a paint temperature of 24° C. After a water rinse, this was baked in an oven at 165° C. for 20 minutes.

The electrodeposition paintability was evaluated according to the following 4 level scale from the number of craters measured per square decimeter of painted surface.

+++: number of craters <20
++: number of craters ≧20, but <40
+: number of craters ≧40, but <60
x: number of craters >60

(5) Workability

In order to evaluate the workability, and particularly in order to evaluate the extent of powdering, of chromated steel sheet prepared as described above, the treated steel sheet with a thickness=1.4 mm was subjected to a 180° bend at a bending radius of 1 mm. Tape was then applied to the bend and peeled off, and the powdering was visually evaluated based on the following 4 level scale:

+++: no powdering
++: slight powdering
+: intermediate powdering
x: heavy powdering.

The results of the above-described performance evaluation testing for Examples 1 to 6 and Comparison Examples 1 to 6 are reported in Tables 2 and 3. Table 2 reports the evaluation results for the Zn/Ni-plated steel sheet, while Table 3 reports the evaluation results for the galvannealed hot-dip-galvanized steel sheet.

Benefits of the Invention

As may be seen from the results in Tables 2 and 3, the chromate treatment method according to the present invention produced workpieces which had an excellent electrodeposition paintability, workability, corrosion resistance, and paint film adherence. The superiority of the present invention over the comparison examples was particularly marked for electrodeposition paintability and workability.

TABLE 2

Treatment workpiece = Zn/Ni-plated steel sheet

| | Examples | | | | | |
|---|---|---|---|---|---|---|
| | 1 | 2 | 3 | 4 | 5 | 6 |
| primary adhesion | | | | | | |
| checkerboard test | +++ | ++ | ++ | +++ | +++ | ++ |
| Dupont impact test | ++ | +++ | ++ | +++ | +++ | ++ |
| Erichsen extrusion test | ++ | +++ | ++ | +++ | ++ | ++ |
| secondary adhesion | | | | | | |
| checkerboard test | ++ | ++ | + | +++ | ++ | ++ |
| salt spray test | ++ | ++ | ++ | +++ | ++ | + |
| electro-deposition paintability | +++ | +++ | +++ | ++ | +++ | +++ |
| workability (powdering) | +++ | +++ | +++ | +++ | ++ | +++ |

| | Comparison Examples | | | | | |
|---|---|---|---|---|---|---|
| | 1 | 2 | 3 | 4 | 5 | 6 |
| primary adhesion | | | | | | |
| checkerboard test | ++ | ++ | ++ | +++ | ++ | + |

TABLE 2-continued

| Treatment workpiece = Zn/Ni-plated steel sheet | | | | | | |
|---|---|---|---|---|---|---|
| Dupont impact test | ++ | +++ | ++ | +++ | ++ | ++ |
| Erichsen extrusion test | +++ | ++ | ++ | ++ | ++ | +++ |
| secondary adhesion | | | | | | |
| checkerboard test | ++ | ++ | + | +++ | ++ | ++ |
| salt spray test | ++ | ++ | ++ | +++ | ++ | + |
| electro-deposition paintability | ++ | ++ | x | + | + | + |
| workability (powdering) | ++ | + | + | x | ++ | + |

TABLE 3

| Treatment workpiece = galvannealed hot-dip-galvanized steel sheet | | | | | | |
|---|---|---|---|---|---|---|
| | Examples | | | | | |
| | 1 | 2 | 3 | 4 | 5 | 6 |
| primary adhesion | | | | | | |
| checkerboard test | ++ | +++ | ++ | +++ | ++ | ++ |
| Dupont impact test | ++ | ++ | ++ | ++ | + | ++ |
| Erichsen extrusion test | +++ | +++ | ++ | +++ | ++ | ++ |
| secondary adhesion | | | | | | |
| checkerboard test | ++ | ++ | + | ++ | + | ++ |
| salt spray test | +++ | ++ | ++ | +++ | ++ | ++ |
| electro-deposition paintability | +++ | +++ | ++ | ++ | ++ | +++ |
| workability (powdering) | ++ | +++ | +++ | +++ | +++ | ++ |
| | Comparison Examples | | | | | |
| | 1 | 2 | 3 | 4 | 5 | 6 |
| primary adhesion | | | | | | |
| checkerboard test | ++ | ++ | ++ | +++ | ++ | + |
| Dupont impact test | + | +++ | ++ | ++ | + | ++ |
| Erichsen extrusion test | ++ | +++ | ++ | +++ | ++ | ++ |
| secondary adhesion | | | | | | |
| checkerboard test | ++ | ++ | + | ++ | + | + |
| salt spray test | +++ | ++ | ++ | +++ | ++ | ++ |
| electro-deposition paintability | + | + | x | + | ++ | x |

TABLE 3-continued

| Treatment workpiece = galvannealed hot-dip-galvanized steel sheet | | | | | | |
|---|---|---|---|---|---|---|
| workability (powdering) | + | x | x | x | x | ++ |

The invention claimed is:

1. A method for the chromate treatment of metal surfaces by contact with an aqueous acidic composition consisting essentially of:

(A) from 4.0 to 51.0 g/L of hexavalent chromium;
(B) from 6.0 to 38.0 g/L of trivalent chromium;
(C) from 0.5 to 97.0 g/L of phosphate ions;
(D) from 0.01 to 2.90 moles/L of a component selected from the group consisting of sulfate ions, nitrate ions, fluoride ions, and mixtures thereof; and
(E) from 0,003 to 0.85 moles/L of a component selected from the group consisting of cations of Cu, Co, Ni, Sn, Fe, and Pb and mixtures thereof, wherein the trivalent chromium/hexavalent chromium weight ratio in said aqueous acidic composition is in the range from 0.2 to 1.4.

2. A method according to claim 1, in which the metal surface treated is covered with a layer of the aqueous acidic composition that is substantially equal in thickness over the entire metal surface and the covering liquid is dried in place on the metal without any intervening water rinse, to form a chromate film with a chromium add-on of 20 to 160 mg/m$^2$ on the metal surface treated.

3. A method according to claim 2, in which the drying is for a period of from 3 to 60 seconds at a temperature of from 60° C. to 260° C. for the metal substrate.

4. A method according to claim 3, wherein the metal surface treated is a galvanized steel surface.

5. A method according to claim 2, wherein the metal surface treated is a galvanized steel surface.

6. A method according to claim 1, wherein the metal surface treated is a galvanized steel surface.

7. An acidic aqueous composition of matter suitable for use in forming a chromate conversion coating on galvanized steel, said composition consisting essentially of water and:

(A) from 4.0 to 51.0 g/L of hexavalent chromium;
(B) from 6.0 to 38.0 g/L of trivalent chromium;
(C) from 0.5 to 97.0 g/L of phosphate ions;
(D) from 0.01 to 2.90 moles/L of a component selected from the group consisting of sulfate ions, nitrate ions, fluoride ions, and mixtures thereof; and
(E) from 0.003 to 0.85 moles/L of a component selected from the group consisting of cations of Cu, Co, Ni, Sn, Fe, and Pb and mixtures thereof, wherein the trivalent chromium/hexavalent chromium weight ratio in said aqueous acidic composition is in the range from 0.2 to 1.4.

* * * * *